US007048143B2

(12) United States Patent
Sanders et al.

(10) Patent No.: US 7,048,143 B2
(45) Date of Patent: May 23, 2006

(54) CONTAINER AND CARTRIDGE FOR DISPENSING PAPER PRODUCTS

(75) Inventors: Richard Lee Sanders, Hattiesburg, MS (US); James J. Lee, Hattiesburg, MS (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 320 days.

(21) Appl. No.: 10/657,621

(22) Filed: Sep. 8, 2003

(65) Prior Publication Data

Related U.S. Application Data

(60) Provisional application No. 60/463,212, filed on Apr. 16, 2003.

(51) Int. Cl.
*A47K 10/24* (2006.01)

(52) U.S. Cl. ..... 221/46; 221/59

(58) Field of Classification Search ..... 221/45, 221/46, 49, 52, 56, 57, 59, 62, 226, 279; 312/61, 71
See application file for complete search history.

(56) References Cited

U.S. PATENT DOCUMENTS

| | | | | |
|---|---|---|---|---|
| 813,594 | A | | 2/1906 | Sexton |
| 1,072,859 | A | | 9/1913 | Kingsley |
| 1,362,449 | A | | 12/1920 | Teall |
| 1,525,040 | A | | 2/1925 | Painter |
| 1,579,429 | A | | 4/1926 | Arms |
| 1,785,039 | A | | 12/1930 | McCorkindale |
| 2,253,742 | A | | 8/1941 | West et al. |
| 3,291,339 | A | * | 12/1966 | Hein ..... 221/45 |
| 3,343,716 | A | | 9/1967 | Peebles |
| 3,425,595 | A | | 2/1969 | Shapira |
| 3,498,688 | A | | 3/1970 | Long et al. |
| 3,647,114 | A | | 3/1972 | Bleuer |
| 3,726,435 | A | | 4/1973 | Williams et al. |
| 3,823,845 | A | * | 7/1974 | Mott et al. ..... 221/59 |
| 4,094,442 | A | | 6/1978 | Radek |
| 4,343,415 | A | | 8/1982 | Radek |

(Continued)

FOREIGN PATENT DOCUMENTS

CH 344824 2/1960

(Continued)

OTHER PUBLICATIONS

Tramonia et al.*

*Primary Examiner*—Kenneth Noland
(74) *Attorney, Agent, or Firm*—Richard M. Shane; Nathan P. Hendon

(57) ABSTRACT

The present invention provides a container for dispensing individual paper products that includes a housing having side walls defining an interior area for receiving a plurality of paper products, wherein one of the side walls defines a slot. The housing further includes a means for urging paper products having a first portion external to the housing and a second portion extending through the slot into the interior area of the housing. The container may be included in a system for dispensing individual paper products that further includes a cartridge containing paper products within the container. The cartridge defines a dispensing opening and a second slot wherein the second portion of the means for urging paper products extends through the second slot into the interior area of the cartridge to contact the paper products and urge the paper products toward the dispensing opening.

19 Claims, 6 Drawing Sheets

U.S. PATENT DOCUMENTS

| | | | |
|---|---|---|---|
| 4,706,844 | A | 11/1987 | Omdoll |
| D296,064 | S | 6/1988 | Omdoll et al. |
| 4,969,575 | A | 11/1990 | Kobayashi |
| 5,540,354 | A | 7/1996 | Annand |
| 5,931,339 | A | 8/1999 | Dodge et al. |
| 6,241,118 | B1 | 6/2001 | Tramontina |
| 6,283,295 | B1 | 9/2001 | Akutagawa et al. |
| 6,378,726 | B1 | 4/2002 | Chan et al. |
| 6,419,113 | B1 | 7/2002 | Tramontina |
| 6,422,416 | B1 * | 7/2002 | Tramontina ..... 221/45 |
| 2004/0206768 | A1 * | 10/2004 | Tramontina et al. |

FOREIGN PATENT DOCUMENTS

| | | |
|---|---|---|
| CH | 368913 | 4/1963 |
| DE | 8911997 | 11/1989 |
| WO | WO 99/30601 | 6/1999 |
| WO | WO 00/33713 | 6/2000 |

* cited by examiner

CONTAINER AND CARTRIDGE FOR DISPENSING PAPER PRODUCTS

RELATED APPLICATIONS

The present application claims priority to U.S. Provisional Application Ser. No. 60/463,212, filed on Apr. 16, 2003.

BACKGROUND OF THE INVENTION

Various types of dispensers for paper products have been developed to provide ready availability of the paper products to users. Such dispensers are often provided in public places such as restaurants or rest rooms where customers remove from the dispenser a desired amount of paper products for personal use. In some high traffic areas, such as fast food restaurants, a large number of customers may use a paper product dispenser such as a napkin dispenser in a short period of time. Therefore, dispensers have been developed that hold a large number of paper products for use by a large number of consumers.

For many applications, it is desirable to have a large dispenser that will function well in a horizontal position as well as a vertical position. This is particularly desirable when there is limited vertical space available. Unfortunately, large horizontal dispensers are subject to a number of drawbacks. First, because access to the body of the dispenser may be limited by structures such as counters or cupboards surrounding the dispenser, it can be difficult to load large quantities of napkins into a large dispenser. Second, if paper products are not properly loaded into the dispenser, the paper products may jam as they are removed thereby preventing further removal of paper products by users. Third, a person refilling a large dispenser is more likely, due to the larger number of paper products involved, to drop some of the paper products onto a floor. Any dropped paper products are then unsanitary and must be discarded, thereby creating more waste and defeating certain benefits of the larger dispenser. Fourth, lacking an assist from gravity, horizontal dispensers require an external force to move the paper products through the dispenser.

Therefore, there is a need for large dispensers, both horizontal and vertical, that reduce the incidence of waste of paper products due to dropping of the paper products during refilling of the container. There is likewise a need for such dispensers that reduce the incidence of jamming of paper products and the resultant inability to dispense further paper products, and further that have a mechanism for moving the paper products toward the dispenser opening so that individual paper products are readily removed.

SUMMARY OF THE INVENTION

The aforesaid needs are fulfilled and the problems experienced by those skilled in the art overcome by the container for dispensing individual paper products of the present invention. In one embodiment, the container includes a housing having side walls that define an interior area for receiving a plurality of paper products. One of the housing side walls defines a slot. The container further includes a spring external to the housing, and a member engaged to the spring, wherein the member extends through the slot into the interior area of the housing. When paper products are inserted in the container, the spring urges the member against the paper products and towards a dispensing opening through which the paper products are dispensed. Desirably, the member applies substantially constant pressure against the paper products.

In one aspect, the member may extend from the slot to from ⅓ to ½ of the distance to the opposing housing side wall. In another aspect, the member may extend substantially from the slot to the opposing housing side wall.

In one aspect, the container may further include a door hingedly or removably attached to the housing. The door may define the dispensing opening through which paper products are dispensed.

In another aspect, the container may further include a track external to the housing wherein the spring is disposed within the track. The track may extend along the length of the housing.

In another embodiment, a system for dispensing individual paper products includes the container described above and a cartridge containing paper products within the container. The cartridge defines a dispensing opening and a second slot. The member extends through the second slot into the interior area of the cartridge to contact the paper products and urge the paper products toward the dispensing opening. The cartridge may include cartridge side walls, a first end wall defining the dispensing opening, and a second end wall opposing the first end wall. In one aspect, the second slot is defined by one of the cartridge side walls and the second end wall.

In another aspect, the housing may include a partial housing side wall. Desirably, the cartridge defines an opening for viewing the paper products.

In another embodiment, a container for dispensing individual paper products includes a housing including side walls defining an interior area for receiving a plurality of paper products, wherein one of the side walls defines a slot. The housing further includes a means for urging paper products. A first portion of the means for urging paper products is external to the housing, and a second portion of the means for urging paper products extends through the slot into the interior area of the housing. In a further aspect, the container may be included in a system for dispensing individual paper products that further includes a cartridge containing paper products within the container. The cartridge defines a dispensing opening and a second slot wherein the second portion of the means for urging paper products extends through the second slot into the interior area of the cartridge to contact the paper products and urge the paper products toward the dispensing opening.

Other features and aspects of the present invention are discussed in greater detail below.

BRIEF DESCRIPTION OF THE DRAWINGS

The present invention will be more fully understood from the following detailed description, taken in conjunction with the accompanying drawings (not to scale), wherein like reference numerals refer to like parts, and in which.

DETAILED DESCRIPTION

Figure 1:
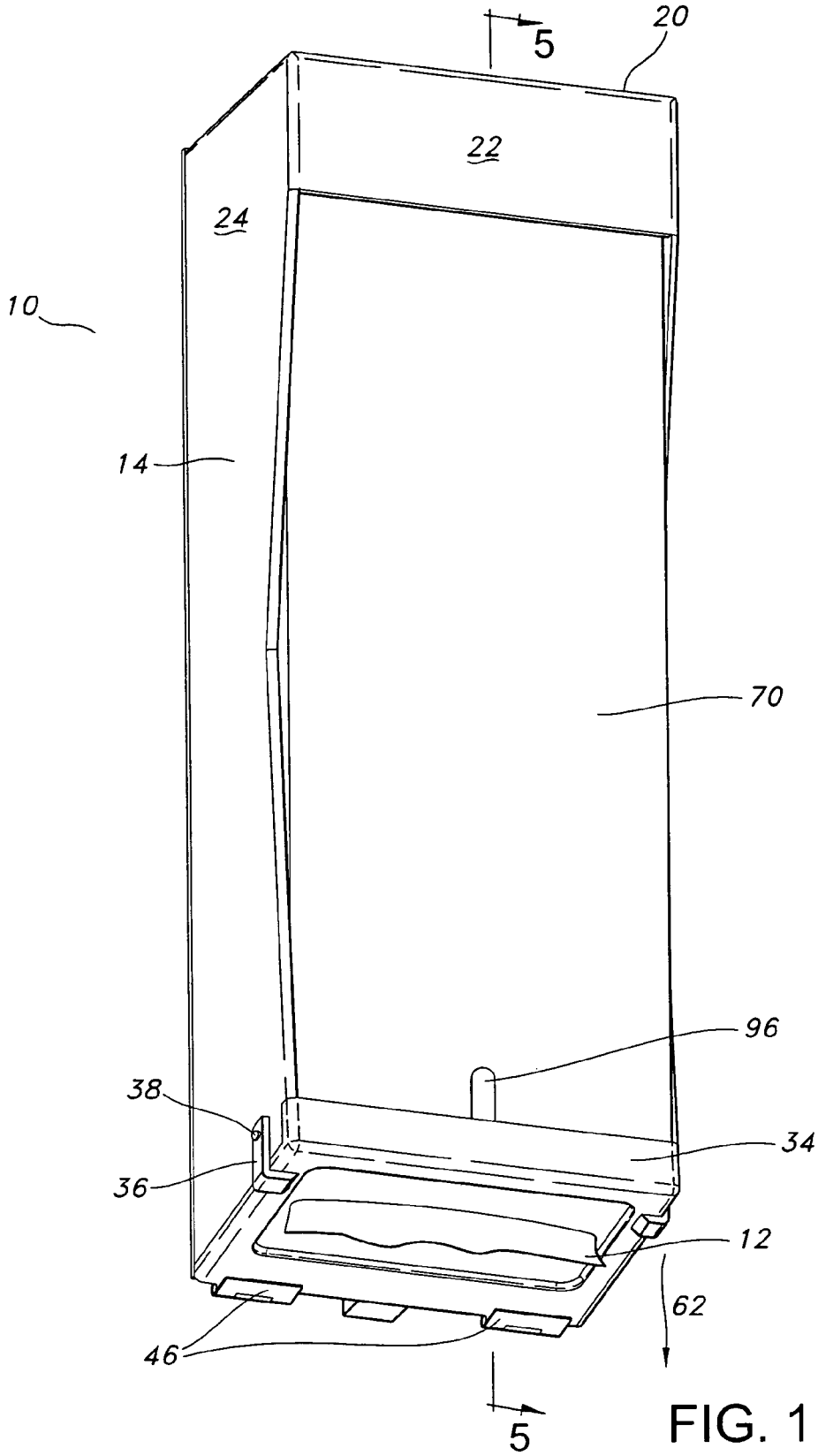
FIG. 1 is a perspective view of an exemplary container for dispensing paper products that contains a cartridge filled with paper products.

Reference will now be made in detail to various embodiments of the invention, one or more examples of which are illustrated in the drawings (not to scale). Each example is provided by way of explanation of the invention and not meant as a limitation of the invention. For example, features illustrated or described as part of one embodiment or figure can be used on another embodiment or figure to yield yet another embodiment. It is intended that the present invention include such modifications and variations.

The present invention is directed to a container for dispensing sheet-like materials. Various sheet-like materials can be dispensed from the container of the present invention such as, for example, paper, nonwoven, and other products. Exemplary sheet-like products include, but are not limited to, facial tissue, towels, bathroom tissue, wipers, napkins, seat covers and so forth. The specific composition of the sheet materials dispensed can vary as desired. Exemplary sheet-like materials and methods of making the same include, but are not limited to, those described in U.S. Pat. Nos. 3,301,746; 3,322,617; 3,650,882; 4,100,324; 4,436,780; 4,659,609; 4,737,393; 5,048,589; 5,284,703; 5,399,412; 5,494,554; 5,607,551; 5,672,248; 5,716,691; 5,772,845; 5,776,306; 6,077,590; 6,273,996; 6,096,152 and so forth. While paper products are generally discussed with regard to the embodiments described herein below, it will be understood that various other products could be substituted therefore.

The container of the present invention can hold and dispense significant numbers of individual sheets. Desirably, the container is sized to hold and dispense at least about 250 sheets. By way of example, the container can contain between about 400 and about 1000 sheets. In certain embodiments, the container can contain and dispense between about 700 and about 900 sheets.

Referring to FIG. 1, a container 10 is disclosed for dispensing paper products 12. The container 10 includes a housing 14 in which the paper products 12 are placed and from which the paper products 12 are dispensed in a dispensing direction 62. Optionally, the paper products 12 may be contained within a cartridge which is placed within the housing 14. The container can be positioned in a vertical or horizontal orientation either alone or within a supporting structure or surface.

Figure 2:
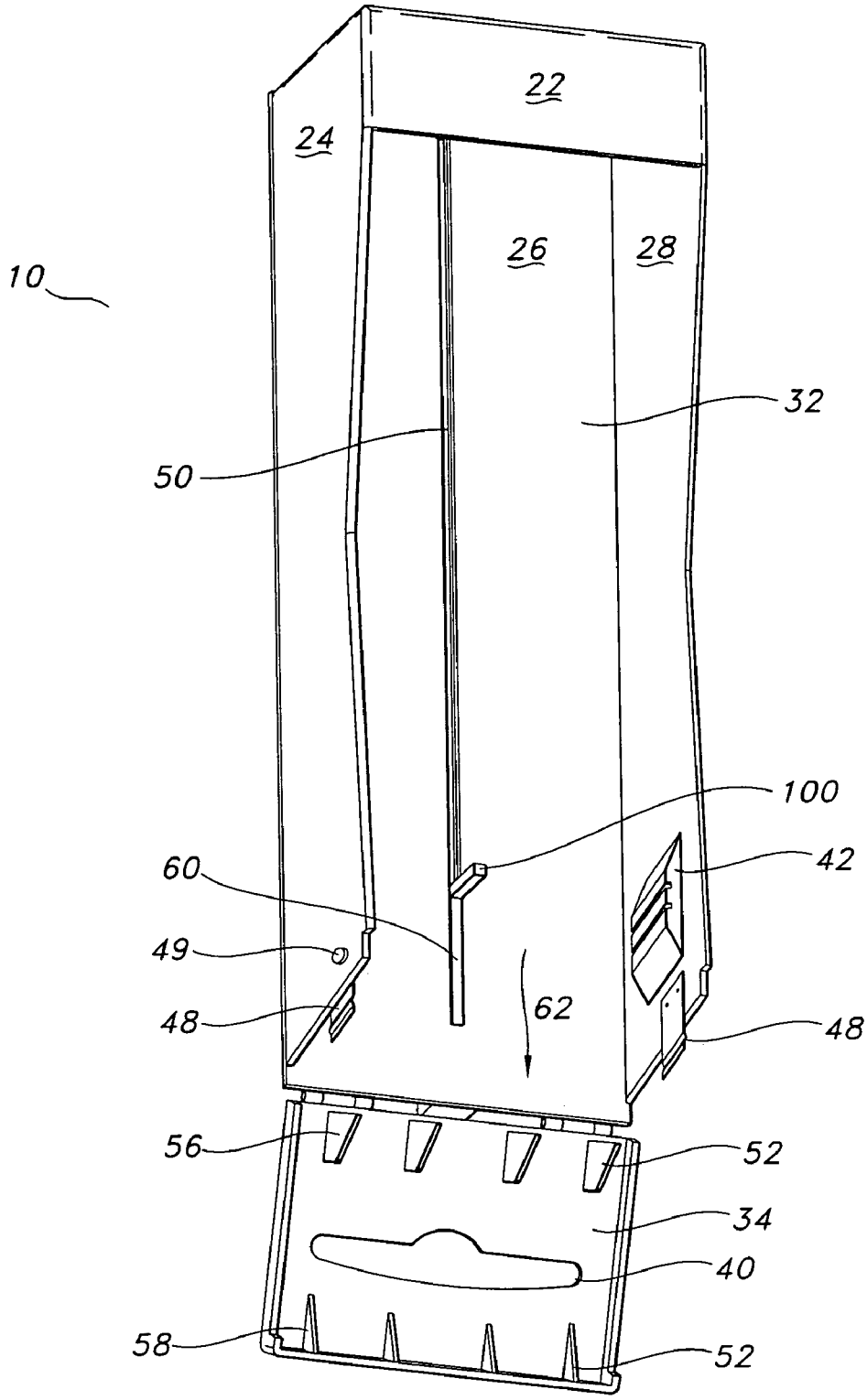
FIG. 2 is a perspective view of the empty container of FIG. 1.

The housing 14 includes an end wall 20 and a number of side walls including a first side wall 22, a second side wall 24, a third side wall 26, and a fourth side wall 28 for housing the paper products 12. The side walls 22, 24, 26, 28 intersect the end wall 20 to define an interior surface 30 (see FIG. 2) of housing 14, within which an interior area 32 (see FIG. 2) is located. The side walls 22, 24, 26, 28 may be partial side walls that leave an opening into the interior area of the housing 14. The side walls 22, 24, 26, 28 and the end wall 20 may each, if desired, be made of two or more planar portions. Such construction strengthens the housing 14 and is useful in locations where the housing might be vandalized. The outer portions of the side walls 22, 24, 26, 28 help withstand any blow or impact to the housing 14 to prevent destruction of the housing, removal of the housing from its mounting, or removal of paper products 12 from the housing.

The container 10 further includes a door 34 which is removably or hingedly attached to one of the side walls 22, 24, 26, 28. For example, the door 34 may be attached to one of the side walls 22, 24, 26, 28 by one or more hinges 46. The door 34 is openable for insertion of paper products 12 into the interior area of the housing 14 when the supply of paper products 12 is depleted and/or runs low.

Desirably, the door 34 includes one or more fasteners 36 that releasably hold the door closed. As used herein, the term "fasteners" means devices that fasten, join, connect, secure, hold, or clamp components together. Fasteners include, but are not limited to, hooks, hook and eye fasteners, latches, snaps, snap-fits, clips, clasps, loop fasteners, interlocking male/female connectors, fishhook connectors, and so forth. The fastener 36 is openable when desired to reopen the door 34. In one embodiment, the fastener 36 pivots from a pivot point 38. Alternatively, the fastener 36 may be made of a resilient material that is bendable to release the door 34. Many other types of suitable releasable fasteners are known to those skilled in the art.

The door 34 further defines a dispensing opening 40 through which the paper products 12 pass as they are dispensed.

Optionally, one or more protrusions may extend into the interior area of the housing. In one embodiment, as partially shown in FIG. 2, the second side wall 24 and the fourth side wall 28 include protrusions 42 extending into the interior area of the housing 14. However, the protrusions 42 could be disposed on any of the walls and one wall can have multiple protrusions. In those embodiments wherein pairs of protrusions are disposed on opposing walls of the housing 14, they can be disposed at the same height or different heights (i.e., staggered). The protrusions 42 desirably comprise a generally downwardly angled structure and can have a geometric and/or curvilinear structure. By way of example only, the protrusions can comprise curved bumpers that may include a plurality of ridges extending across the curved bumpers perpendicular to the dispensing direction. The protrusions 42 extend into the interior area 32 to contact paper products 12 and thereby oppose the movement of paper products 12 in the dispensing direction. By extending into the interior area 32 to contact paper products 12, the protrusions 42 impede the movement of paper products 12 toward the dispensing opening, but do not prohibit such movement. The use of protrusions to control dispensing is described, for example, in U.S. Pat. No. 6,241,118 to Tramontina and U.S. Pat. No. 6,378,726 to Chan et al., the entire contents of which are incorporated herein by reference.

As noted above, the door 34 may be hingedly attached to one of the side walls 22, 24, 26, 28 by one or more hinges 46. As used herein, the term "hinge" refers to a jointed or flexible device that connects and permits pivoting or turning of a part to a stationary component. Hinges include, but are not limited to, pivotable connectores, such as those used to fasten a door to frame, and living hinges. Living hinges may be constructed from plastic and formed integrally between two members. A living hinge permits pivotable movement of one member in relation to another connected member. The door 34 is openable for insertion of paper products 12 into the interior area 32 of the housing 14 when the supply of paper products is depleted and/or runs low. The fastener 36 that holds the door 34 closed may, for example, include interlocking tabs 48. The interlocking tabs 48 are movable when desired to reopen the door 34. In one embodiment, the interlocking tabs 48 are movable by pressing an attached button 49 or other actuating mechanism. Any other type of fastener 36 known to those skilled in the art for reopenably securing the door 34 may be used.

Desirably, the door 34 further includes one or more control ribs 52 that extend into the interior area 32 to contact paper products when the door is in the closed position. The control ribs 52 space, slow, align, and/or support paper products as the same are moved toward the door 34 and through the dispensing opening 40. Size, shape, and spacing of the control ribs can be used to control dispensing of the paper products. The control ribs 52 may have different dimensions to properly support and guide the paper products into the dispensing opening 40. For example, a tall rib member 56 extends into the interior area 32 by a greater amount than a short rib member 58. The tall rib members 56 and short rib members 58 are illustrated to show an exemplary dispensing configuration. As one example, the tall rib member 56 may have a height ranging from about 1 to about 2 inches at the location where it intersects with the third side wall 26 and an offset or height ranging from about 0.1 to about 0.5 inch adjacent the dispensing opening 40. The short rib member 58 may have a height ranging from about 0.5 to about 1.5 inch at the location where it intersects with the first side wall 22 and an offset or height ranging from 0 to about 0.25 inch adjacent the dispensing opening 40. The rib members may have various widths or thicknesses and the width of a rib member may vary along any dimension or dimensions. Desirably, the portion of the rib member contacting the paper product will be relatively thin and smooth to minimize friction. The use of rib members is further described in U.S. Pat. No. 6,241,118 to Tramontina and PCT Publication WO 99/30601, the entire contents of which are incorporated herein by reference.

The container 10 further includes a means for urging paper products 50 toward the dispensing opening 40 in the door 34. Various alternatives are possible within the scope of the invention to urge paper products toward the door 34. The means for urging paper products 50 may comprises any structure that allows paper products to be urged towards and dispensed from the dispensing opening 40 in the door 34. In one embodiment, the means for urging paper products 50 includes a member 100 that extends through a slot 60 in the third sidewall 26 of the housing 14. As discussed more fully below in conjunction with FIGS. 5 and 6, the member 100 is engaged to a spring which, when compressed, applies force to the member in the dispensing direction 62. The member 100, in turn, applies an urging force to the stack of paper products.

The dispensing opening 40 may have many shapes within the scope of the present invention, as long as the opening provides easy access for a user. Optionally, the dispensing opening may also be configured to provide metered delivery of individual paper products. Desirably, the paper products are interfolded, tabbed, or tab interfolded to provide metered feeding of individual paper products one at a time. Folding devices, such as boards or plates, have long been used to longitudinally fold webs and other sheet-like materials in order to form a stack of folded sheets. The sheets are, generally speaking, drawn over the folding device wherein the shape and configuration of the device causes the sheet to twist and bend thereby producing the desired fold. Folding devices have heretofore been provided in a variety of shapes and configurations in order to achieve the desired fold lines and folding patterns. Folding devices have been used to form a number of different folds including, for example, half-folds, quarter folds, c-folds, v-folds, j-folds, w-folds, z-folds, and so forth.

In addition, for more complex folds requiring multiple fold lines, it is known to form the necessary fold lines using two or more folding devices in series. In this regard, folding boards have also been used in series to achieve inter-folded or inter-leafed sheets, that is to say sheets folded such that they partially envelope portions of another sheet. Inter-leafed sheets are commonly employed in stacks as a mechanism to facilitate removal of the individual sheets from a dispenser. Withdrawal of a first sheet through a dispenser opening pulls the enveloped portion of a second sheet through the dispenser opening such that it extends out of the dispenser opening and is exposed. Having a portion of the subsequent sheet extending out of the dispenser opening greatly facilitates removal of the same from the dispenser by the user. By way of example only, various folding devices, folding patterns and inter-folding schemes are described in the following U.S. Pat. Nos. 3,401,928; 3,679,094; 3,817,514; 3,841,620; 4,131,271; 4,502,675; 5,868,276; 6,045,002; and 6,168,848. However, the present invention does not require the use of interfolded paper products.

The housing 14 may be made from numerous materials and by numerous methods known to those skilled in the art. The housing 14 may be made of plastic such as polyethylene, nylon, and so forth. However, other suitable materials, such as other plastics or metals, may be provided for any or all of the parts of the housing 14. As one example, the housing 14 may be made of an injection-molded plastic. The protrusions 42 and control ribs 52 are desirably formed integral with the housing 14. However, the protrusions 42 and control ribs 52 may be formed separately from the housing 14 and attached later. Also, the protrusions 42 and control ribs 52 may be made of different material from the housing 14 if desired. For example, the protrusions 42 and control ribs 52 may be made of a more resilient material than the materials described above, such as an elastomer or rubber.

Figure 3:
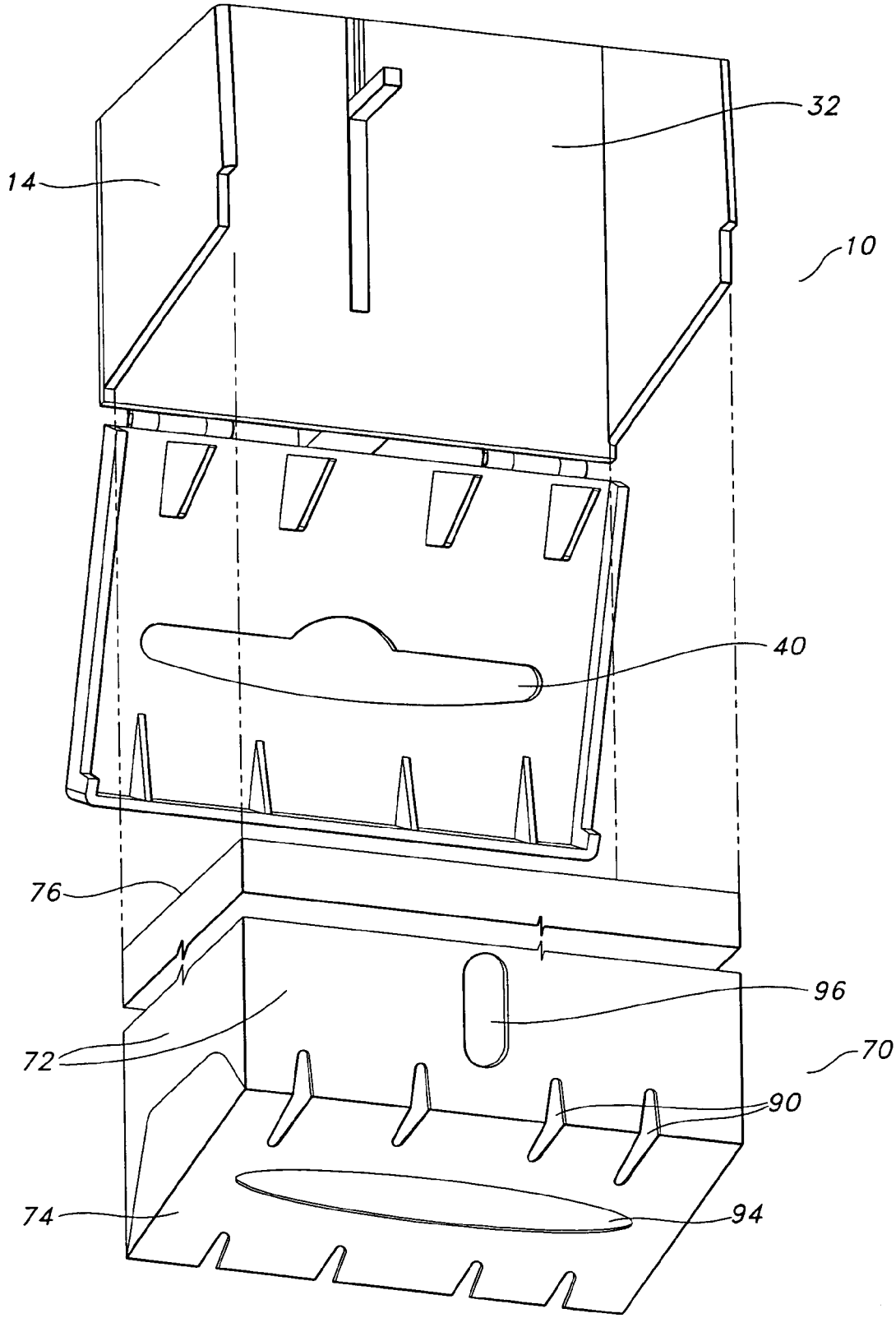
FIG. 3 is an exploded perspective view of the container and cartridge of FIG. 2 with the cartridge being inserted into the container.

Desirably, as mentioned above, a cartridge may be provided for holding paper products to be dispensed to a user. As shown in FIG. 3, a cartridge 70 having outside walls 72 is provided for insertion into the interior area 32 of the housing 14 for containing paper products to be dispensed. The cartridge has a bottom end 74 that is adapted to dispense paper products. Opposing the bottom end 74 is a top end 76. The cartridge 70 is sized to fit within the interior area 32 of the housing 14. Desirably, the cartridge 70 is sized to be only slightly smaller than the housing 14 to maximize the number of paper products 12 contained within the cartridge. If the housing 14 includes a partial side wall, the cartridge should be large enough to prevent the cartridge from falling from the opening in the housing 14.

The cartridge 70 can hold and dispense significant numbers of individual sheets. Desirably, the cartridge 70 is sized to hold and dispense at least about 250 sheets. By way of example, the cartridge 70 can contain between about 400 and about 1000 sheets. In certain embodiments, the cartridge 70 can contain and dispense between about 700 and about 900 sheets.

The cartridge includes a plurality of openings. The bottom end 74 of the cartridge 70 has an opening 94 corresponding to the dispensing opening 40 through which paper products 12 are dispensed. Additionally, one or more openings 90 corresponding to the control ribs 52 may be at the bottom end 74 of the cartridge 70. The control ribs 52 extend through the openings 90 to support and/or align the paper products 12 for dispensing through the dispensing opening 40.

To permit visual inspection of the amount of paper products remaining in the cartridge 70, the cartridge 10 may define at least one additional opening 96 in one of the cartridge outside walls 72. The contents of the cartridge 70 are visible through the opening 96. Desirably, at least one such opening 96 is visible from outside the container 10. Two or more openings 96 may be provided in a single wall to provide a greater range of visual inspection.

Figure 4:
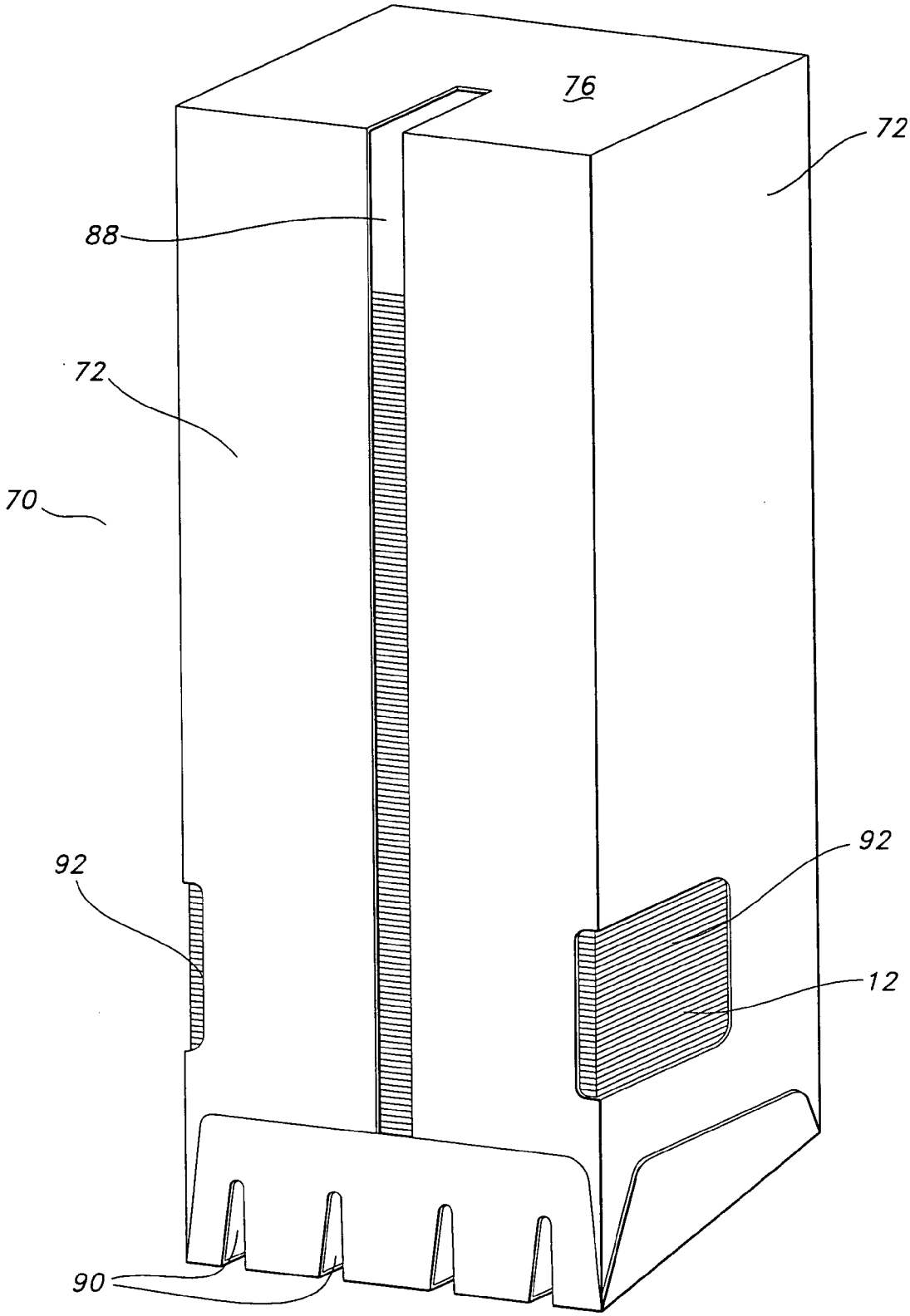
FIG. 4 is a perspective back view of an exemplary cartridge.

FIG. 4 is a perspective view showing the cartridge 70 fully inserted into the housing 14 mounted in the countertop 16.

As noted above, the cartridge includes a plurality of openings through the cartridge. One such opening is a slot 88 through which extends the means for urging paper products 50 when the cartridge 70 is loaded into the housing 14. The slot 88 is disposed at one of the outside walls 72 of the cartridge 70. Alternatively, the slot 88 may extend around the top end 76 of the cartridge 70 to allow the means for urging paper products 50 to be received by the top end 76 of the cartridge.

Optionally, the cartridge 70 may include one or more of another opening 92 that corresponds to the optional protrusions 42 in the housing 14. The openings 92 are disposed in the outside walls 72 of the cartridge 70 so that the openings 92 can encompass and receive the protrusions 42 extending from the interior surface 30 of the housing 14. Thus, upon placement of the cartridge 70 in the housing 14, the protrusions 42 and rib members 58 contact the paper products 12 within the cartridge 70 and act upon the paper products as described above.

The openings in the cartridge described above can be formed by removal of removable portions that may either be removed (or simply not formed) during manufacture of the cartridge or removed just prior to installation of the cartridge in the housing. If the removable portions are to be removed as part of the manufacturing process, the cartridge should be shipped to the user wrapped, for example in a polyethylene bag, to preserve the sterility of the paper products in the cartridge. If the removable portions are to be removed as part of the installation process, the edges of the removable portions should be weakened, scored, etc. for easy removal.

The cartridge 70 is desirably made of heavy paper or cardboard, but may be made of any other suitable material known to those skilled in the art such as, for example, durable plastic films and so forth.

Figure 5:
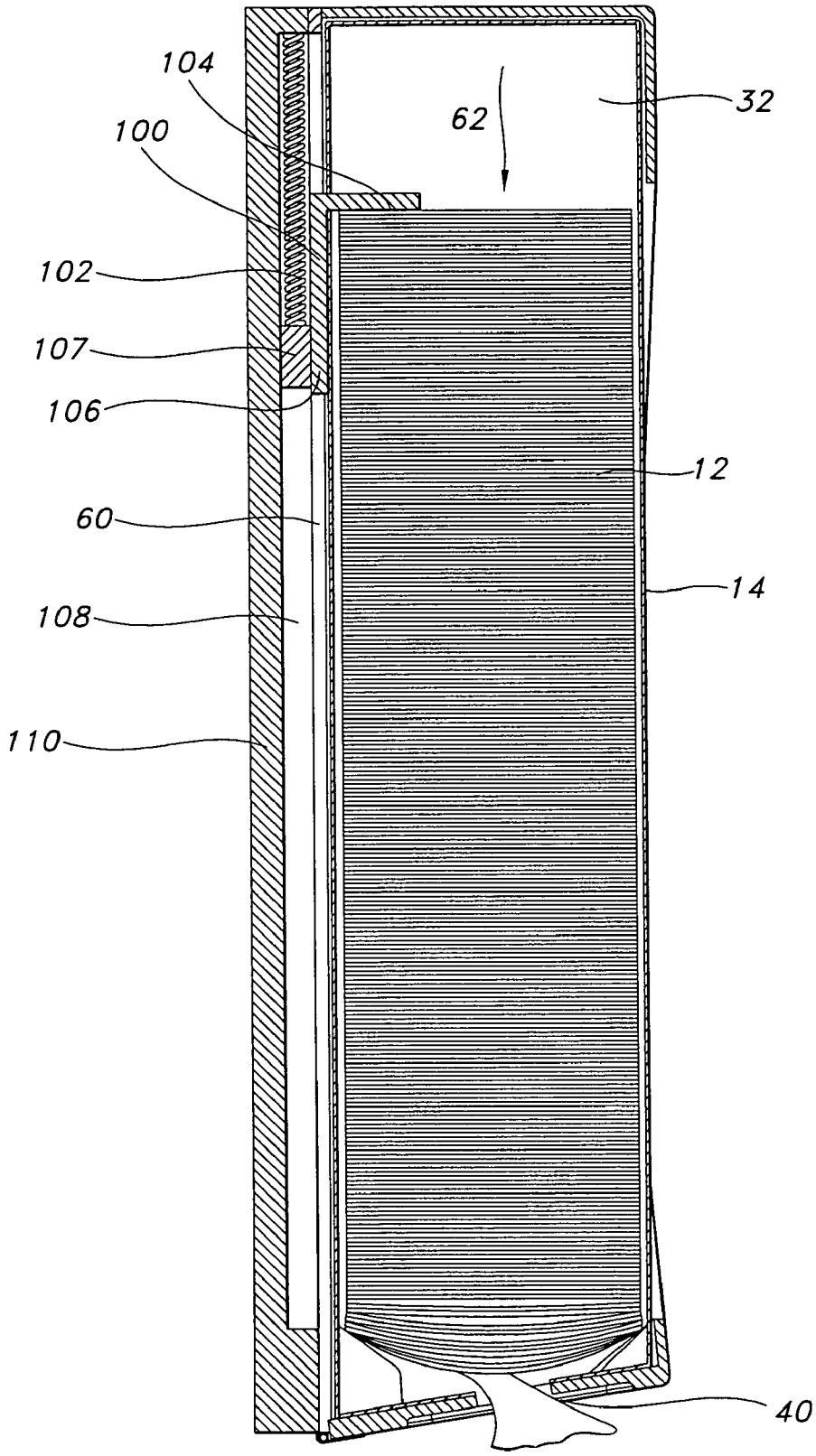
FIG. 5 is a cross-sectional view of the container of FIG. 1 taken along line 1—1 of FIG. 1.
Figure 6:
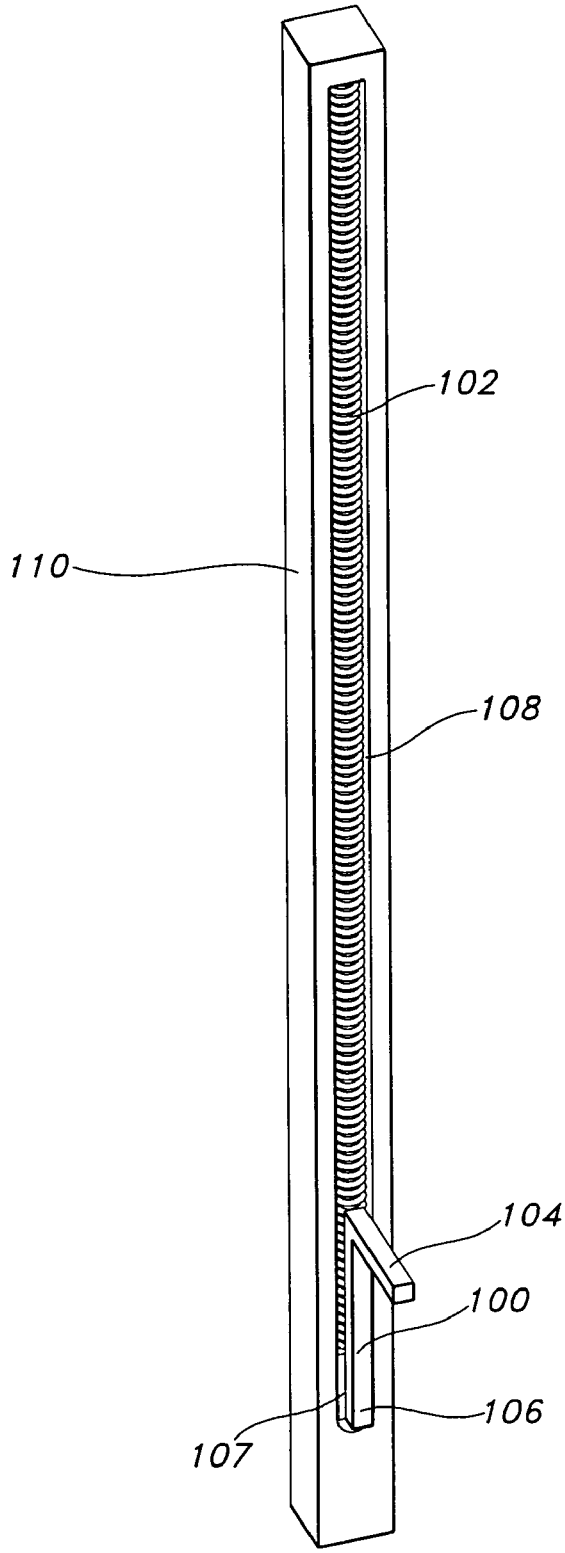
FIG. 6 is a perspective view of an exemplary force-applying mechanism for use with the container and cartridge of FIG. 1.

Referring now to FIGS. 5 and 6, the member 100 is shown having a first portion 104 extending into the interior area 32 of the housing 14. The first portion 104 of the member 100 engages and applies force to the paper products 12. The first portion 104 extends into the interior area 32 a sufficient distance to engage the paper products and may extend substantially to the opposing side wall of the housing 14. Desirably, the first portion 104 extends from about ⅓ to about ½ of the way across the width of the interior area 32 of the housing 14. The first portion 104 of the member 100 should be sufficiently sturdy to withstand substantial deflection from application of force against the paper products 12.

The member 100 further includes a second portion 106 disposed substantially within the slot 60 in the sidewall of the housing 14. The second portion 106 of the member 100 is attached to a moveable slide 107 disposed within a track 108. The cross-sectional area of the slide 107 is slightly smaller than the cross-sectional area of the track 108 to allow for free movement of the slide within the track. The slide 107 is also sufficiently long to substantially reduce and/or eliminate rocking within the track 108 that would inhibit free movement.

The track 108 is defined within a track housing 110. Desirably, the track housing 110 is external to the sidewalls of the housing 14. The track housing 110 is be attached to the sidewall over the slot 60 by any of a variety of ways known to those skilled in the art including, but not limited to, using adhesives, screws, nuts and bolts, and/or nails, and so forth.

Force is applied to the slide 107 in the dispensing direction 62 by a spring 102 disposed within the track 108. The slide 107 and the spring 102 move within the track 108, but are constrained from falling out of the track because the slot 60 in the side wall of the housing 14 is narrower than the slide and the spring. Because the spring 102 is compressed within the track 108, the spring 102 urges the slide 107 and the attached member 100 in the dispensing direction 62. Thus, when paper products 12 are placed in the container 10, thereby engaging the member 100, moving the member towards the end wall 20 of the container 10, and compressing the spring 102, the extension force of the spring acting on the member urges the paper products 12 toward the dispensing opening 40. When cartridge 70 containing paper products 12 is loaded in container 10, the member 100 extends through the cartridge slot 88 (shown in FIG. 4) to engage the paper products 12. Use of the spring mechanism described above allows the container 10 to be used in those situations where paper products are to be dispensed in a substantially horizontal or upward direction, i.e., where the paper products will not be urged towards the dispensing opening by the force of gravity.

The spring 102 is sized to provide sufficient force to urge the paper products 12 to the dispensing opening 40. Desirably, the spring 102 applies substantially constant pressure against the paper products 12 at all positions of travel. Application of substantially constant pressure helps to prevent over-application of force when the member 100 is towards the end wall 20 of the housing 14 and under-application of force when the member is closer to the dispenser opening 40.

It will be apparent to those skilled in the art that various modifications and variations can be made in the present invention without departing from the scope and spirit of the invention. It is intended that the present invention include such modifications and variations as come within the scope of the appended claims and their equivalents.

We claim:

1. A container for dispensing individual paper products which are disposed in a cartridge having a slot, the container comprising:

a housing including housing side walls defining an interior area for receiving a plurality of paper products, wherein one of the housing side walls defines a slot;

a spring external to the housing; and a member engaged to the spring, wherein the member extends through the slot into the interior area of the housing and through a slot in a cartridge disposed within the housing.

2. The container of claim 1 further comprising a door hingedly or removalby attached to the housing.

3. The container of claim 2 wherein the door defines a dispensing opening.

4. The container of claim 3 wherein the spring urges the member towards the dispensing opening.

5. The container of claim 1 wherein the housing comprises a partial housing side wall.

6. The container of claim 1 further comprising a track external to the housing wherein the spring is disposed within the track.

7. The container of claim 6 wherein the track extends along the length of the housing.

8. The container of claim 1 wherein the member extends substantially from the slot to the opposing housing side wall.

9. The container of claim 1 wherein the member extends from the slot to from ⅓ to ½ of the distance to the opposing housing side wall.

10. The container of claim 1 further comprising paper products contained within the housing wherein the paper products are urged towards the dispensing opening by the member.

11. The container of claim 10 wherein the member applies substantially constant pressure against the paper products.

12. A system for dispensing individual paper products, the system comprising:

the container of claim 1; and a cartridge containing paper products, the cartridge defining a dispensing opening and a second slot wherein the member extends through the second slot into the interior area of the cartridge to contact the paper products and urge the paper products toward the dispensing opening.

13. The system of claim 12 wherein the cartridge comprises cartridge side walls, a first end wall defining the dispensing opening, and a second end wall opposing the first end wall, wherein the second slot is defined by one of the cartridge side walls and the second end wall.

14. The system of claim 13 wherein the housing comprises a partial housing side wall.

15. The system of claim 14 wherein the cartridge defines an opening for viewing the paper products.

16. The system of claim 12 wherein the spring applies substantially constant pressure against the paper products.

17. A container for dispensing individual paper products which are disposed in a cartridge having a slot, the container comprising:

a housing including side walls defining an interior area for receiving a plurality of paper products, wherein one of the side walls defines a slot;

a means for urging paper products, wherein a first portion of the means for urging paper products is external to the housing, and wherein a second portion of the means for urging paper products extends through the slot into the interior area of the housing and through a slot in a cartridge disposed within the housing to urge the plurality of paper products.

18. A system for dispensing individual paper products, the system comprising:

the container of claim 17; and a cartridge containing paper products, the cartridge defining a dispensing opening and a second slot wherein the second portion of the means for urging paper products extends through the second slot into the interior area of the cartridge to contact the paper products and urge the paper products toward the dispensing opening.

19. A cartridge for containing paper products and for dispensing from a container having a housing including side walls defining an interior area for receiving a plurality of paper products and where one of the housing side walls defines a slot, a spring external to the housing, and a member engaged to the spring where the member extends through the slot and into the interior area of the housing, the cartridge comprising:

side walls defining an interior area containing paper products;

a dispensing opening defined within one of the side walls; and a slot defined within one of the side walls, wherein when the container is disposed within a container, a member extends through the container and into the interior area of the cartridge and urges the paper products toward the dispensing opening.

* * * * *